US006363904B1

(12) United States Patent
Kurihara et al.

(10) Patent No.: US 6,363,904 B1
(45) Date of Patent: Apr. 2, 2002

(54) MULTI-POSITION, OPERATOR-CARRIED, FOUR-CYCLE ENGINE

(75) Inventors: Katsumi Kurihara, Nagoya (JP); Shiro Kawamoto, Chandler, AZ (US); James M. Grayson, Wonder Lake, IL (US)

(73) Assignee: MTD Southwest Inc., Chandler, AZ (US)

( * ) Notice: Subject to any disclaimer, the term of this patent is extended or adjusted under 35 U.S.C. 154(b) by 0 days.

(21) Appl. No.: 09/634,230

(22) Filed: Aug. 9, 2000

Related U.S. Application Data

(60) Continuation of application No. 09/256,953, filed on Feb. 24, 1999, now abandoned, which is a division of application No. 08/614,835, filed on Mar. 8, 1996, now Pat. No. 6,047, 678.

(51) Int. Cl.[7] ..... F01M 1/100

(52) U.S. Cl. ..... 123/196 R; 184/11.1

(58) Field of Search ..... 123/196 R, 196 W; 184/11.1, 11.2, 13.1

(56) References Cited

U.S. PATENT DOCUMENTS 5,176,116 A * 1/1993 Imagawa ..... 123/196 W

* cited by examiner

*Primary Examiner*—Noah P. Kamen
(74) *Attorney, Agent, or Firm*—Brinks Hofer Gilson & Lione

(57) ABSTRACT

A power tool having a rotary implement driven by a four-cycle engine. The engine crankcase is through a passageway which extends through a camshaft to a valve chamber. The rotating shaft member inhibits the escape of lubricating oil when the engine is running while permitting a lubricating oil mist to circulate through the engine.

6 Claims, 4 Drawing Sheets

MULTI-POSITION, OPERATOR-CARRIED, FOUR-CYCLE ENGINE

CROSS-REFERENCE TO RELATED APPLICATION

This application is a continuation of Ser. No. 09/256,953, filed Feb. 24, 1999 now abandoned which is a division of U.S. patent application Ser. No. 08/614,835, filed Mar. 8, 1996, now U.S. Pat. No. 6,047,678 entitled "MULTI-POSITION OPERATOR-CARRIED FOUR-CYCLE ENGINE".

TECHNICAL FIELD

This invention relates to four-cycle engines and, more particularly, to small, operator-carried, four-cycle engines having a crankcase vent for preventing oil loss.

BACKGROUND ART

Operator-carried power tools such as line trimmers, blower/vacuums, chain saws and the like are typically powered by two-cycle internal combustion engines or electric motors. Two-cycle engines have well recognized exhaust emission problems. Until relatively recently, it was believed that four-cycle engines were too heavy and could not be operated through the range of orientations necessary for an operator-carried power tool. The present applicant, however, recently introduced a commercially successful four-cycle engine powered line trimmer illustrated in U.S. Pat. Nos. 5,241,932 and 5,421,292 which are incorporated by reference herein.

The Everts '932 patent describes a number of alternative techniques for lubricating the overhead valves and rocker arms oriented in the valve chamber. A sealed lubricant system is described as a number of alternative mist lubrication systems. The mist lubrication systems enable the engine to be inclined very significantly from the vertical orientation. However, when the engine is run in the inverted position for extended periods of time, oil begins to leak from the engine breather.

It is an object of the present invention to increase the length of time an operator-carried, four-cycle engine can be run in the inverted position before oil begins to leak from the engine breather.

It is a further object of the present invention to provide simple and easy-to-manufacture engine components to block the flow of oil from the crankcase.

These objects and other features and advantages of the present invention will become apparent upon further review of the specification and the drawings.

DISCLOSURE OF INVENTION

A first embodiment of the invention comprises an operator-carried power tool and a lightweight, four-cycle, internal combustion engine for driving a rotary-driven implement. The four-cycle engine is mounted on the frame to be carried by the operator in a normal operating position. The four-cycle engine includes a lightweight block defining a cylindrical bore and crankcase, an enclosed cam case and a cam bearing. The engine includes a conventional piston and connecting rod reciprocating within the cylindrical bore in cooperation with a crank pin of the crankshaft.

The crankshaft is provided with an axial shaft rotatably mounted on the engine block. The crankshaft has an internal axial passageway formed therein with two axial, spaced-apart inlet/outlet ports and a crankshaft web-counterweight affixed to the axial shaft and the crank pin. The web-counterweight has an internal radially extending passageway in communication with one of the inlet/outlet ports of the axial shaft. The second inlet/outlet port of the axial shaft is in communication with the cam case to thereby interconnect the cam case and the crankcase via the crankshaft passageway. When the engine is in operation, the rotating passageway precludes the flow of free oil and large oil droplets from the crankcase to the cam case while allowing oil mist laden air to pass freely therebetween.

A second embodiment of the invention comprises a camshaft that has a central opening through which an oil mist generated by a splasher may pass from the crank case to the cam case portion of the engine housing. A port located in the camshaft allows oil droplets to be centrifuged from the central opening in the camshaft to the cam case from which oil is drained back to the crankcase. In this way, liquid oil is separated from the oil mist. The oil mist passes through an oil mist flow passage that extends to the valve chamber at the upper region of the engine assembly.

BEST MODE FOR CARRYING OUT THE INVENTION

Figure 1:
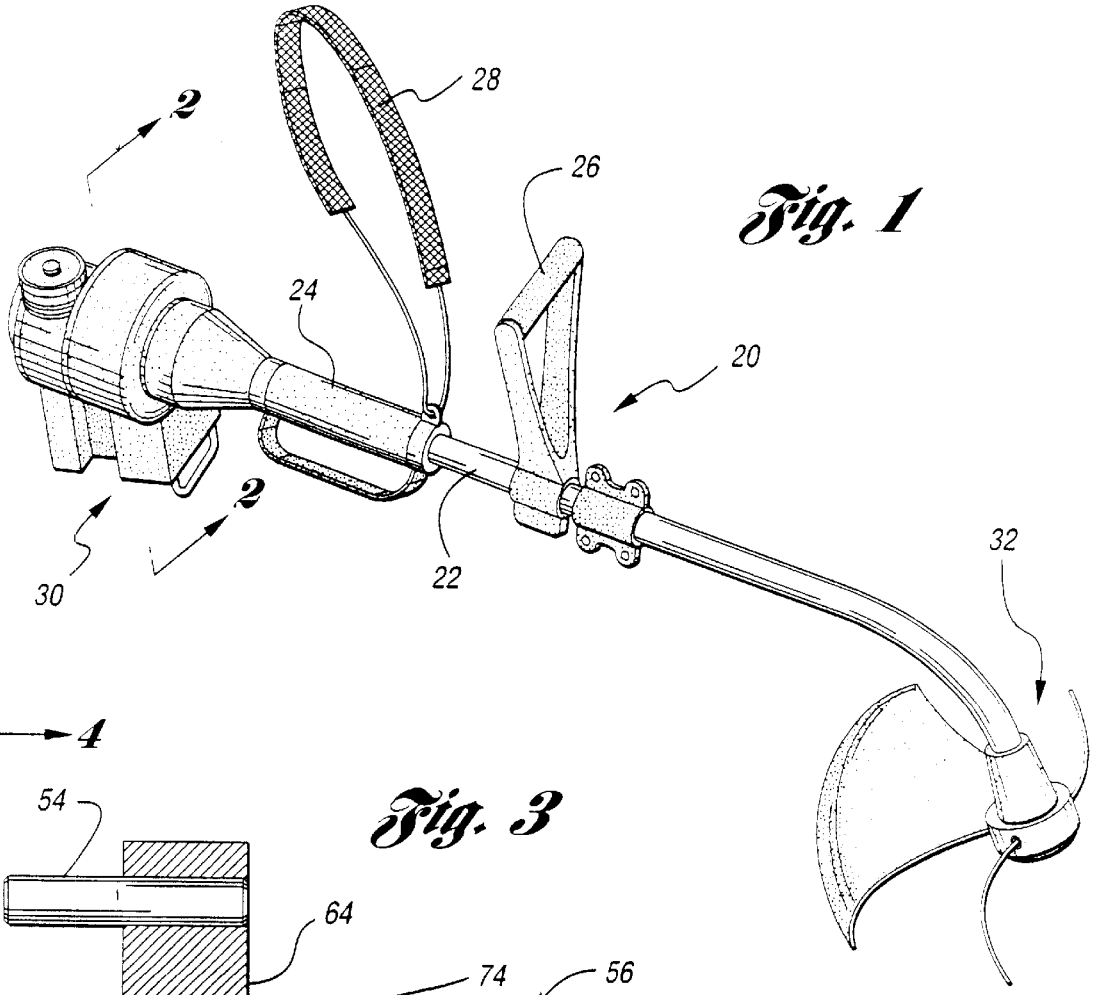
FIG. 1 is a perspective view illustrating a line trimmer of the present invention.

FIG. 1 illustrates a line trimmer 20 made in accordance with the present invention. Line trimmer 20 is used for illustration purposes, but it should be appreciated that other hand-held power tools carried by operators, such as chain saws or blower/vacuums, can be made in a similar fashion.

Line trimmer 20 has a frame 22, which comprises an elongated aluminum tube. Frame 22 has a pair of handles 24 and 26 to be grasped by the operator during normal use. Strap 28 is placed over the shoulder of the user in a conventional manner in order to more conveniently carry the weight of the line trimmer during use. Attached to one end of the frame generally behind the operator is a four-cycle engine 30. The engine drives a conventional flexible shaft which extends through the center of the tubular frame to drive an implement 32 having a rotary cutting head or the like affixed to the opposite end of the frame. It should be appreciated that, in the case of a chain saw or a blower/vacuum, the implement would be a cutting chain or a rotary impeller, respectively.

Figure 2:
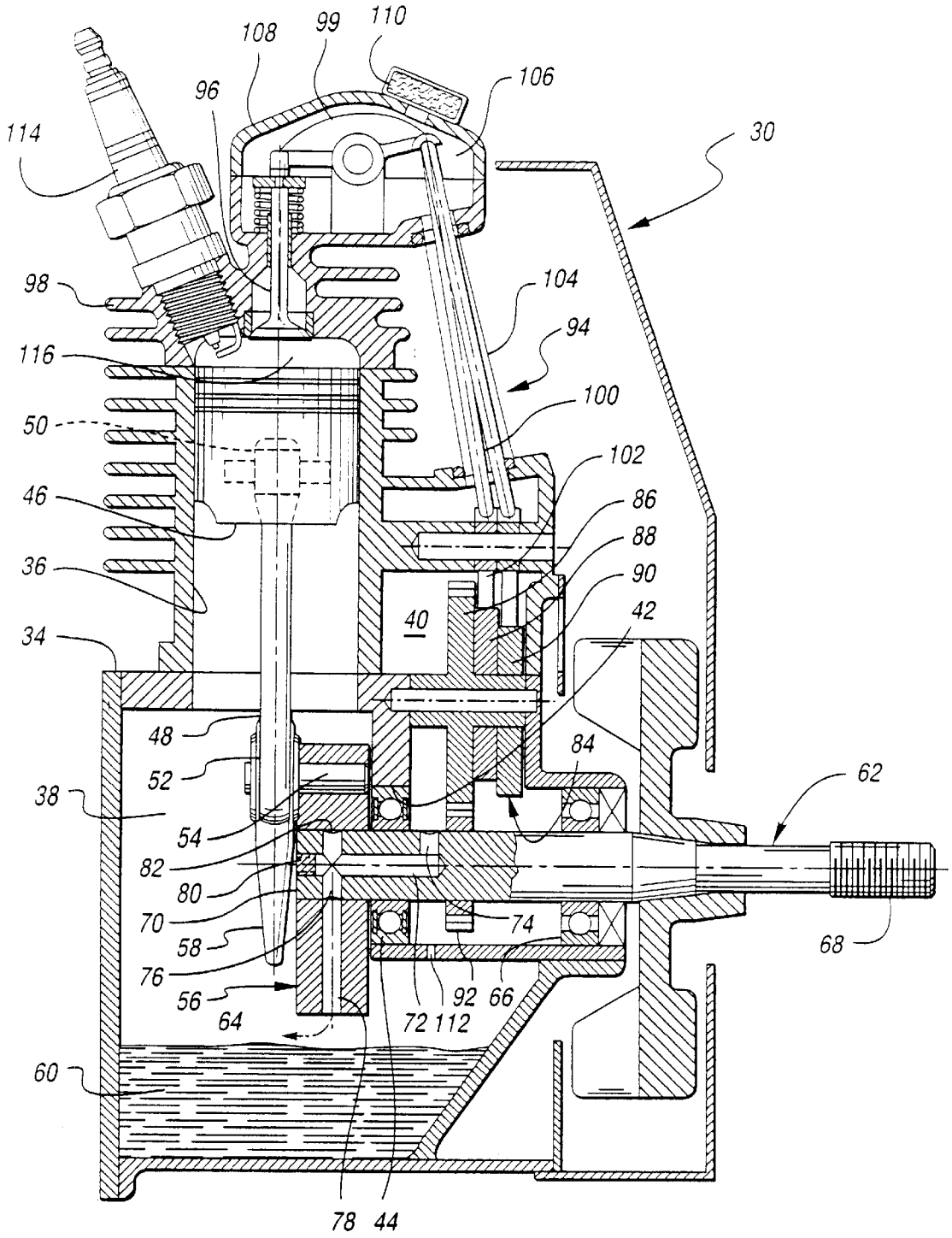
FIG. 2 is a cross-sectional side elevation of the engine of the present invention.

FIG. 2 illustrates a cross-sectional side view of the four-cycle engine 30. Four-cycle engine 30 is made up of a lightweight aluminum engine block 34 having a cylindrical bore 36 formed therein. Engine block 34 defines two internal, substantially closed cavities; i.e., crankcase 38 and cam case 40. Engine block 34 also defines a bearing journal surface 42 sized to receive an annular bearing such as a sealed roller ball-bearing 44 illustrated in the present embodiment. It should be noted, however, that other types of sealed bearings such as a lead alloy babbitt bearing could be used, although a sealed roller ball-bearing is preferred. Piston 46 and connecting rod 48 form a piston and connecting rod assembly which reciprocates within cylindrical bore 36 in a conventional manner. Connecting rod 48 is provided with a bearing 50 shown in phantom outline, which pivotally cooperates with piston 46, and a bearing 52 which pivotally cooperates with crankpin 54 of crankshaft 56. In the embodiment illustrated, connecting rod 48 is provided with a splasher 58 which intermittently engages oil 60 in the lower region of crankcase 38.

Crankshaft 56 in the preferred embodiment illustrated is made up of three main components: crankpin 54, axial shaft 62 and web-counterweight 64. The web-counterweight 64 is affixed to the axial shaft 62 and crank pin 54 to maintain the crankpin spaced radially apart and parallel to the axis of axial shaft 62. In the embodiment illustrated, crankshaft 56 is of a cantilevered crank design and fabricated from three separate components. It should be appreciated, of course, that a crankshaft can be formed of a unitary forging as would be the case of a convention U-shaped crankshaft in which the axial shaft would be made up of two portions, one on each side of the crankpin, and in which a pair of web-counterweights would be provided in order to support the crankpin on both sides of the connecting rod 48. The present technology is equally applicable to a non-cantilevered crank U-shaped design of either fabricated or unitary construction.

Axial shaft 62 of crankshaft 56 is generally elongated and is pivotally mounted upon engine bearing 44 and a second axially spaced-apart engine bearing 66. Axial shaft 62 has an output end 68 and an input end 70. An axial passage 72 extends through a portion of the axial shaft adjacent input end 70. The axial passage connects to two axial, spaced-apart inlet/outlet ports 74 and 76. Inlet/outlet port 74 is positioned in a region of axial shaft 62 which falls within the cam case 40. Inlet/outlet port 76 falls within a region of axial shaft 62 within crankcase 38. Inlet/outlet port 76 communicates with a radial passageway 78 formed within web-counterweight 64 to form a continuous passageway connecting the crankcase 38 to cam case 40 via radial passageway 78, inlet/outlet port 76, axial passage 72 and inlet/outlet path 74.

To facilitate fabrication, axial passageway 72 is formed by drilling a hole in the first end 70 of axial shaft 62 and subsequently plugging the end of the hole using a plug 80. Inlet/outlet ports 74 and 76 are formed by radially drilling holes in axial shaft 62. For convenience in aligning inlet/outlet port 76 with radial passageway 78 in the web-counterweight, inlet/outlet port 76 is preferably through-hole cross drilled through axial shaft 62, which intersects a circumferentially extending groove 82 aligned with inlet/outlet port 76 and radial port 78 so that angular alignment of axial shaft 62 and web-counterweight 64 is not critical.

In operation, splasher 58 will intermittently strike the oil 60 within the crankcase so that air filling the remainder of crankcase 38 will be laden with a fine oil mist. As the piston reciprocates within the bore of the crankcase, the volume accordingly changes as there is a sinusoidal fluctuation in crankcase pressure. This pressure fluctuation causes oil mist laden air to pulse into and out of the passageway extending through crankshaft 56, carrying a fine oil mist into the cam case 40. This oil mist serves to lubricate camshaft assembly 84, which is made up of a cam drive gear 86 and intake and exhaust cams 88 and 90, respectively. Cam gear 86 is driven by crank gear 92 affixed to axial shaft 62, which rotates the camshaft assembly 84 at one-half of crankshaft speed. A valve train 94 operatively connects the camshaft 84 to intake valve 96 and an exhaust valve (not shown) located in cylinder head 98. Valve train 94 is an overhead valve rocker arm-type design which utilizes a pair of pivotal rocker arms 99 pivotally connected to the cylinder head 98 to cooperate with a cam lobe and one of the valves via a push rod 100 and a cam follower 102.

It should be appreciated that various cam, cam follower and push rod designs can be utilized in practicing the present invention, as shown in the Everts '932 and the Hoffman '292 patents incorporated herein. The preferred embodiment shown in FIG. 2, for example, utilizes a pair of pivotal frog leg-type cam followers 102, but conventional tappet-type followers could alternatively be used.

Push rods 100 are oriented in a pair of push rod tubes 104 which cooperate with engine block 34 and cylinder head 98. Push rod tubes 104 surround push rods 100 and interconnect cam case 40 and valve chamber 106, allowing oil mist laden air to pass therebetween. Cylinder head 98 is provided with a rocker cover 108 which defines valve chamber 106 therebetween. A breather 110 is affixed to the rocker cover in order to allow air to pass between valve chamber 106 and the atmosphere. Preferably, breather 110 is filled with a fibrous material to entrap oil and to prevent oil escape. Breather 110 enables the pressure in valve chamber 106 to closely approximate atmospheric pressure resulting in the flow of oil mist laden air from the crankcase to the valve chamber 106 via cam case 40 as the pressure within the crankcase varies above and below atmospheric pressure as the piston reciprocates.

The oil-laden mist circulating through the cam case 40 and valve chamber 106 will lubricate the moving parts contained therein as the mist condenses on the part surfaces. Mist condensate will form oil droplets which will, via gravity feed, gradually flow back down the push rod tubes 104 into the cam case 40. In order to facilitate the return of oil from the cam case to the crankcase, a small orifice 112 is formed in the lower wall of the engine block to facilitate oil return. It should be appreciated that the effective diameter of orifice 112 must be substantially smaller than the effective diameter of the passageway extending through the crankshaft. Orifice 112 is ideally sized so it is just large enough to enable oil condensate to drip back into the crankcase at the rate at which the condensate is formed. Having an orifice larger than necessary would enable oil to leak into the valve case in the event the crankshaft axis is aligned vertically with the crankshaft output end oriented downward.

While it should be appreciated that an engine of the present invention could not run indefinitely in the inverted position, as eventually the oil mist would transfer oil from the crankcase to the valve chamber in sufficient quantities to cause leakage, the present invention can substantially increase the length of time an engine utilizing a mist lubrication system can be run in the inverted or inclined state. The design also significantly increasing the range of angular orientations that the engine may be run at in a continuous manner.

Figure 3:
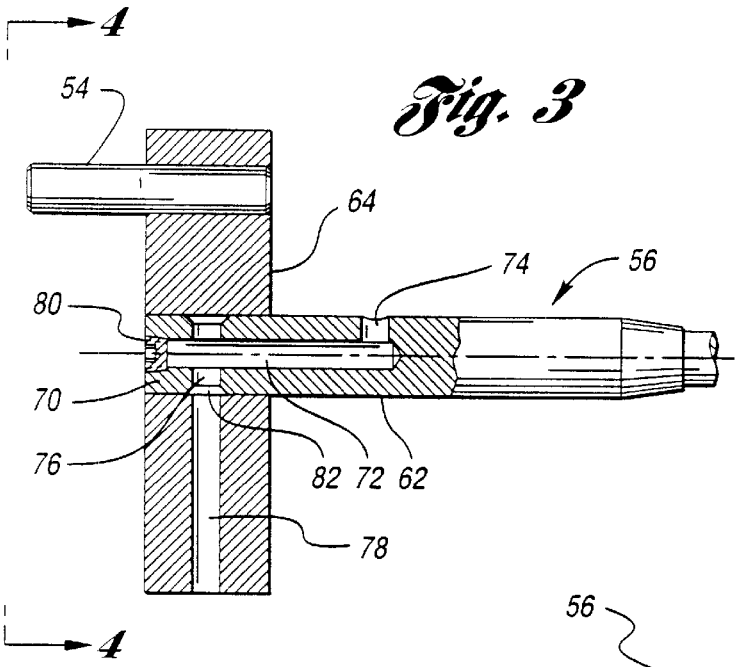
FIG. 3 is an enlarged, partially cut away side elevational view of the crankshaft of the present invention.
Figure 4:
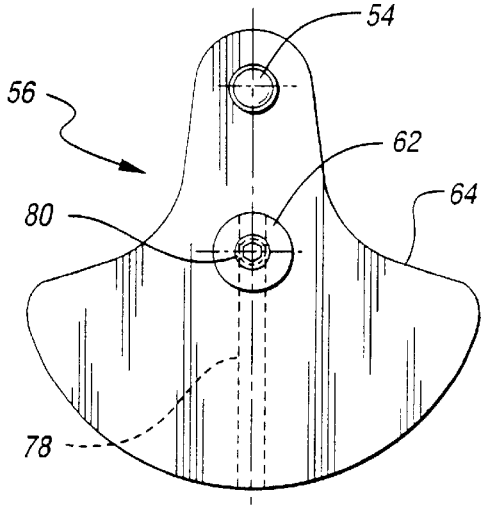
FIG. 4 is an axial end view of the crankshaft taken along the line 4—4 of FIG. 3.

FIGS. 3 and 4 show the crankshaft in greater detail. It should be appreciated that the crankshaft and the passageway formed therethrough is a principal difference between the present invention and the power tool and engine therefor illustrated in the Everts '932 patent. The components of the engine, which are not necessarily directly related to the improvement in a mist lubrication system, have not been described in detail. The general operation of the engine and the description of conventional engine components, such as sparkplug 114, combustion chamber 116 and other components such as the intake and exhaust system including the intake port, the exhaust port, carburetor and muffler, are illustrated in the Everts' 932 patent.

Figure 5:
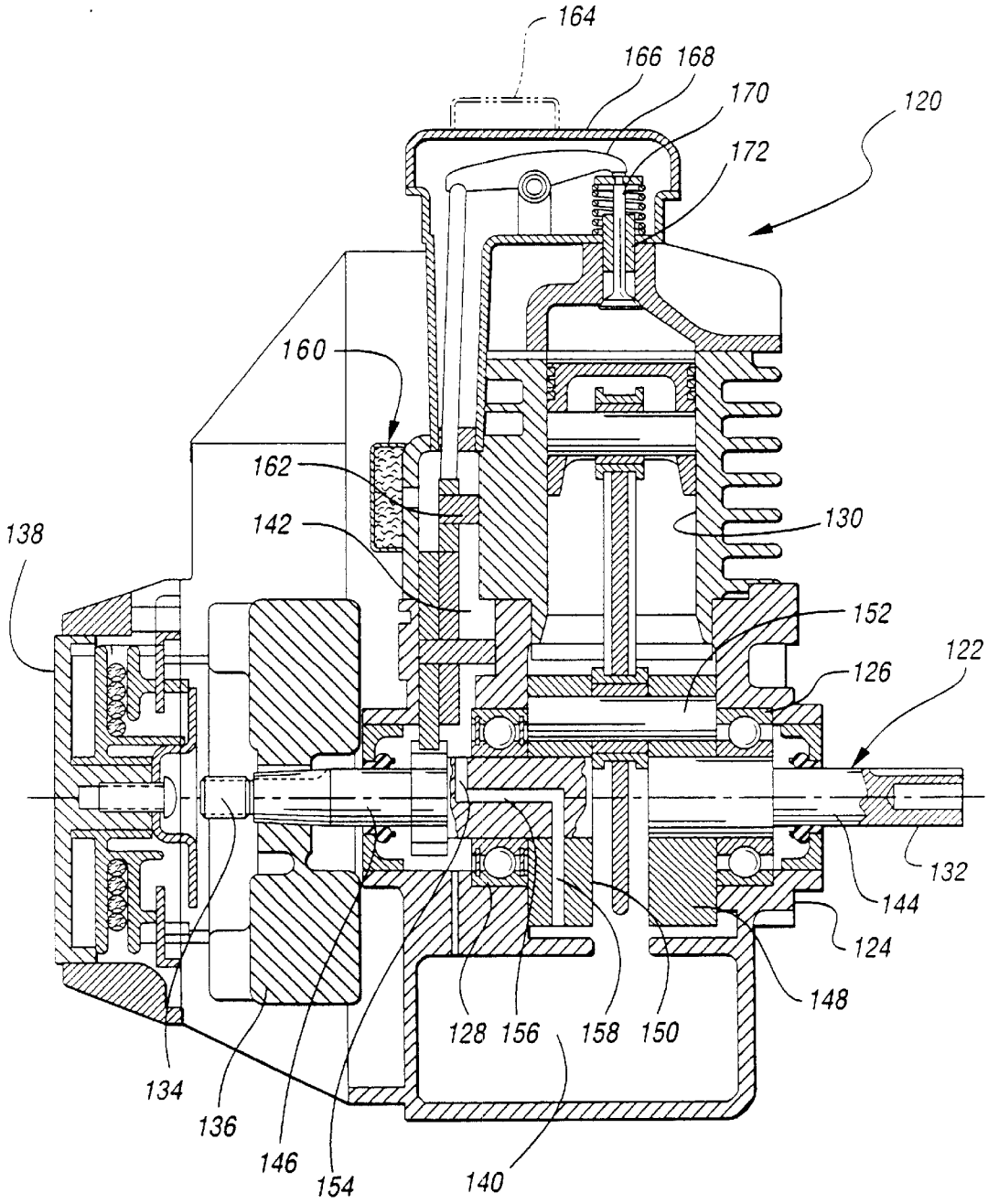
FIG. 5 is a cross-sectional side elevation of an engine illustrating a second embodiment of the invention.

FIG. 5 is an alternative second engine embodiment 120 illustrating an alternative crankshaft construction. Second engine embodiment 120 has a generally U-shaped, double-ended crankshaft 122 which is pivotally supported relative to engine block 124 by a pair of bearings 126 and 128 oriented on opposite sides of cylinder bore 130. Crankshaft 122 is provided with an output end portion 132 for attachment to a rotary tool or the like and a free end portion 134, which is attached to flywheel 136 and recoil starter 138.

Crankshaft 122 is provided with an internal passageway 156/158 to accommodate the flow of mist-laden air between crankcase 140 and cam case 142, as generally described with reference to the four-cycle engine 30 of FIGS. 2–4.

Crankshaft 122 is made up of five sub-components, in the embodiment illustrated, which are pressed together; i.e., axially aligned, spaced-apart output shaft 144 and accessory shaft 146, first web-counterweight 148, second web-counterweight 150 and crankpin 152. Second web-counterweight 150 is provided with a radial passageway 154, and accessory shaft 146 is provided with a generally Z-shaped passageway 156 which, in cooperation with the radial passageways 154 and 158, connects crankcase 140 and cam case 142. Passageway 154 is provided with an inlet/outlet port in communication with the crankcase and an inlet/outlet port in communication with cam case as illustrated in FIG. 5 and as described with reference to the first four-cycle embodiment 30. The oil mist is generated by splasher 143 located between counterweights 145 and 147.

During engine operation, the pressure within crankcase 140 will fluctuate generally sinusoidally. The pressure differential between the crankcase and the cam case will cause air laden with a fine oil mist to flow into and out of the crankcase through passageway 158. Fine oil mist droplets will be able to flow into the cam case. However, free oil and large droplets will be precluded from flowing through passageway 158 as a result of the centrifugal force caused by the rotation of the crankshaft.

Cam case 142 is vented to atmosphere via a breather 164. The breather preferably includes a fine fibrous material to trap oil and prevent oil from being discharged from the engine. With reference to FIG. 5, a breather can be placed at one of two locations. Breather 160 is shown affixed to the engine block in the proximity of cam follower 162. Alternatively, breather 164 can be located on rocker cover 166. The breather communicates with the crankcase through passageway 158, but it is isolated from the crankcase as shown, for example, in FIG. 5.

It should be appreciated that locating the breather on the rocker cover causes more mist-laden oil to flow to the rocker arms 168 and valves 170 located in the cylinder head. Locating the breather on the side of the engine will reduce oil flow to the rocker arms and valves relative to the location of breather 164. Which of the two locations selected is a matter of design choice. The amount of oil can be experimentally determined to be necessary to lubricate the valves and rockers without having excessive oil consumption resulting from oil flowing past valve 170 and valve stem insert 172.

Figure 6:
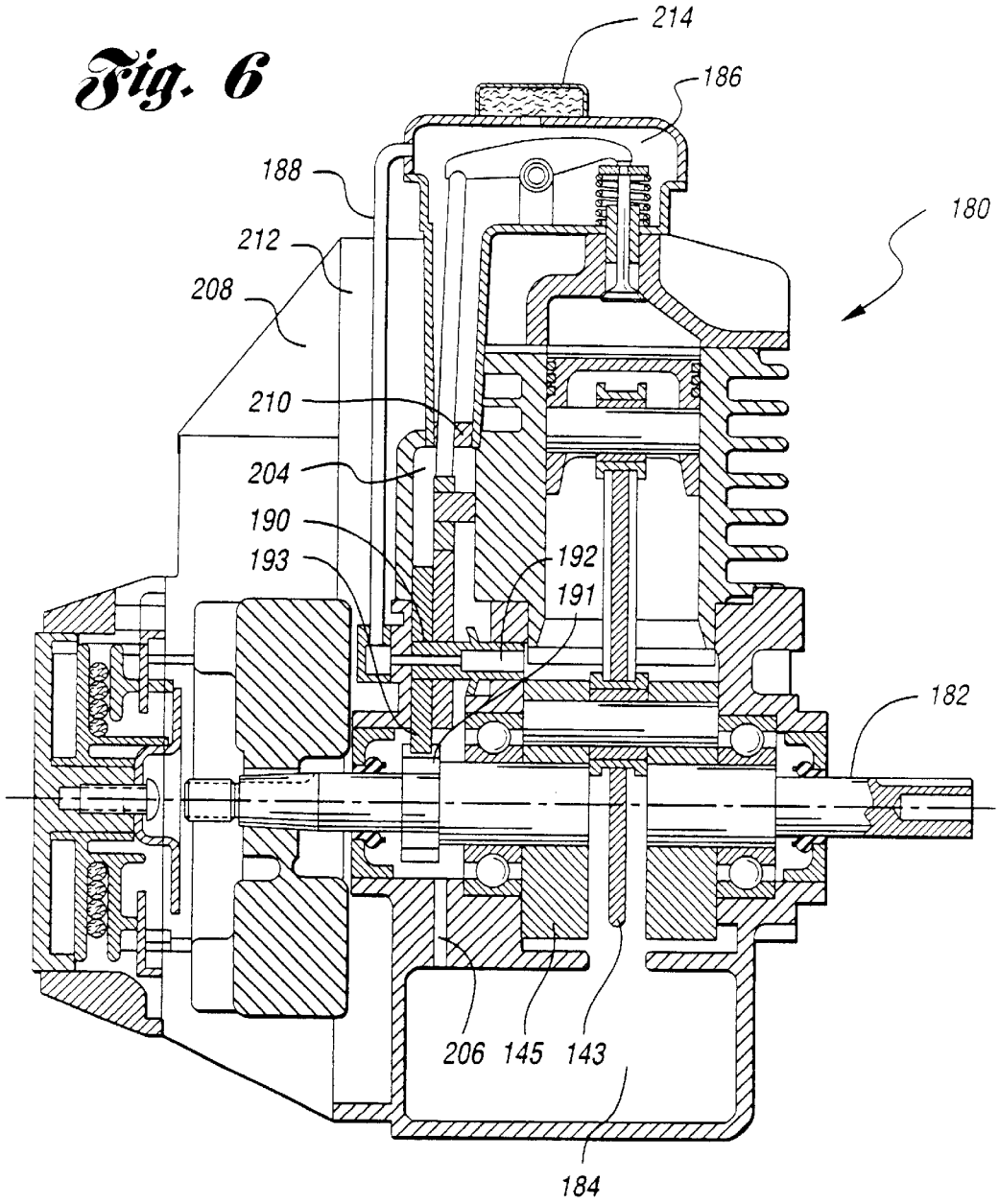
FIG. 6 is a cross-sectional side elevation of an engine illustrating a third embodiment.

FIG. 6 illustrates a third engine embodiment 180. Engine 180 has a generally U-shaped, double-ended crankshaft 182 of the same general configuration as crankshaft 122 of the second engine embodiment 120. However, there is no air and mist passageway formed in crankshaft 182. Crankcase 184 is connected to valve chamber 186 via passageway 188 formed by an external tube and internal passageway extending through camshaft 190. The camshaft is driven by crankshaft gear 191 and camshaft drive gear 193.

Figure 7:
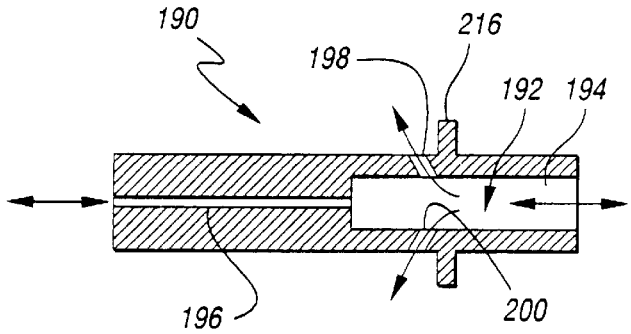
FIG. 7 is an enlarged cross-sectional view of the camshaft for the third engine embodiment of FIG. 6.

The camshaft 190 is shown in the enlarged cross-sectional elevational view in FIG. 7. The camshaft 190 has a stepped hole 192 extending axially therethrough. The stepped hole 192 has a large diameter region 194 adjacent the end of camshaft 190 in communication with crankcase 184. The opposite end of camshaft 190 is provided with a small diameter hole 196 in communication with passageway 188, which serves to interconnect crankcase 184 and valve chamber 186.

During engine operation, an oil-laden mist flows into and out of the axial passageway 192 extending through camshaft 190. Fine oil mist passes freely through passageway 192. Larger oil droplets will be spun by centrifugal force to the outer wall of large diameter passageway section 194 and will be expelled via ports 198 and 200 into cam case 204, where the oil will flow back to crankcase 184 by passing through oil return port 206.

It should be appreciated that valve chamber 186 is connected to cam chamber 204 via push rod tubes 208. A seal 210 extending about push rod 212 substantially isolates valve chamber 186 from cam chamber 204. Oil mist-laden air flowing through hollow camshaft 190 and passageway 188 will ultimately end up in valve chamber 186 as a result of the location of breather 214. The oil which lubricates the valve train components will flow via gravity down push rod tube 208 leaking past seal 210 back into the cam case 204 and ultimately to crankcase 184.

An oil shedder 216 is preferably formed about the periphery of camshaft 190 proximate ports 198 and 200. Shedder 216, when rotating, serves to prevent oil from flowing back into ports 198 and 200 in the event that cam case 204 becomes flooded with oil when the engine is tipped up on end for an extended period of time. Shedder or slinger 216 is optional and is not necessary in all applications.

It should be understood, of course, that while the invention herein shown and described constitutes a preferred embodiment of the invention, it is not intended to illustrate all possible variations thereof. Alternative structures may be created by one of ordinary skill in the art without departing from the spirit and scope of the invention described in the following claims.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A four-stroke cycle internal combustion engine for use with an operator-carried, multiple-position implement comprising an engine housing having an upper cylinder housing portion and a lower crankcase housing portion for engine lubricating oil;

a crankshaft journalled for rotation in the crankcase housing portion;

an oil mist generator drivably connected to the crankshaft including a splasher engageable with the lubricating oil as it is driven by the crankshaft, the splasher thereby generating an oil mist in the crankcase housing portion;

a camshaft connected drivably to the crankshaft, a cam case, the camshaft being journalled in the cam case;

an oil mist flow passage in the camshaft, a radial port in the camshaft connecting the oil mist flow passage to the cam case;

the oil mist flow passage communicating with the crankcase housing portion whereby liquid oil in the oil mist generated by the splasher is transferred to the cam case; and a valve chamber housing secured to the cylinder housing portion, a valve chamber lubrication passage means for transferring oil mist from the oil mist flow passage in the camshaft to the valve chamber housing.

2. The engine set forth in claim 1 wherein the oil mist flow passage comprises a central opening extending axially through the camshaft, one end of the central opening communicating with the crankcase housing portion and the opposite end thereof communicating with the lubrication passage means.

3. The engine set forth in claim 2 wherein the camshaft has a radially extending shedder carried on the outer periphery thereof adjacent the radial port in the camshaft whereby liquid oil in the oil mist is delivered by centrifugal force throughout the cam case.

4. An operator-carried, lightweight power tool for use in multiple positions relative to a reference plane comprising an elongated frame;

an implement mounted at one end of the frame and a four-stroke cycle internal combustion engine mounted at an opposite end of the frame;

the engine having an engine housing with an upper cylinder housing portion and a lower crankcase housing portion for engine lubricating oil;

a crankshaft journalled for rotation in the crankcase housing portion;

an oil mist generator drivably connected to the crankshaft including a splasher engageable with the lubricating oil as it is driven by the crankshaft, the splasher thereby generating an oil mist in the crankcase housing portion;

a camshaft connected drivably to the crankshaft, a cam case, the camshaft being journalled in the cam case;

an oil mist flow passage in the camshaft, a radial port in the camshaft connecting the oil mist flow passage to the cam case;

the oil mist flow passage communicating with the crankcase housing portion whereby liquid oil in the oil mist generated by the splasher is transferred to the cam case; and a valve chamber housing secured to the cylinder housing portion, a valve chamber lubrication passage means for transferring oil mist from the oil mist flow passage in the camshaft to the valve chamber housing.

5. The power tool set forth in claim 4 wherein the oil mist flow passage comprises a central opening extending axially through the camshaft, one end of the central opening communicating with the crankcase housing portion and the opposite end thereof communicating with the lubrication passage means.

6. The power tool set forth in claim 5 wherein the camshaft has a radially extending slinger carried on the outer periphery thereof adjacent the radial port in the camshaft whereby liquid oil in the oil mist is delivered by centrifugal force throughout the cam case.

* * * * *